US007073968B2

(12) United States Patent
To et al.

(10) Patent No.: US 7,073,968 B2
(45) Date of Patent: Jul. 11, 2006

(54) FASTENING BINDER RING MECHANISMS TO BINDERS

(75) Inventors: Chun Yuen To, Hong Kong (CN); Weng Io Ng, Hong Kong (CN)

(73) Assignee: World Wide Stationary Manufacturing Company, Ltd., Hong Kong (CN)

( * ) Notice: Subject to any disclaimer, the term of this patent is extended or adjusted under 35 U.S.C. 154(b) by 206 days.

(21) Appl. No.: 09/954,095

(22) Filed: Sep. 17, 2001

(65) Prior Publication Data

US 2003/0053849 A1 Mar. 20, 2003

(51) Int. Cl.
*B42F 3/00* (2006.01)
*B42F 13/12* (2006.01)
*B42F 13/36* (2006.01)

(52) U.S. Cl. ..... 402/60; 402/26; 402/36; 402/75; 24/95; 24/347; 24/350; D19/26; D19/27; D19/32

(58) Field of Classification Search ..... 402/26, 402/36, 60, 75; D19/26, 27, 32; 24/95, 24/347, 350
See application file for complete search history.

(56) References Cited

U.S. PATENT DOCUMENTS

| | | | | |
|---|---|---|---|---|
| 1,456,036 | A | | 5/1923 | Nissen |
| 1,709,955 | A | | 4/1929 | Schade |
| 2,888,934 | A | | 6/1959 | Segal |
| 3,159,411 | A | | 12/1964 | McKowen |
| 3,175,847 | A | | 3/1965 | McKowen |
| 3,809,485 | A | | 5/1974 | Beyer |
| 3,950,107 | A | | 4/1976 | Seaborn |
| 4,295,747 | A | | 10/1981 | Errichiello |
| 4,697,945 | A | | 10/1987 | Geiger |
| 4,722,628 | A | | 2/1988 | Rager |
| 4,935,998 | A | | 6/1990 | Frazier et al. |
| 5,035,526 | A | | 7/1991 | Cooper et al. |
| 5,100,253 | A | | 3/1992 | Cooper |
| 5,106,223 | A | | 4/1992 | Kraus |
| 5,160,209 | A | | 11/1992 | Schuessler |
| 5,180,247 | A | | 1/1993 | Yu |
| 5,265,967 | A | | 11/1993 | Han |
| 5,269,616 | A | | 12/1993 | O'Neill |
| 5,286,128 | A | | 2/1994 | Gillum |
| 5,354,142 | A | | 10/1994 | Yu |
| 5,368,407 | A | | 11/1994 | Law |
| 5,378,073 | A | | 1/1995 | Law |
| 5,393,155 | A | | 2/1995 | Ng |
| 5,476,335 | A | | 12/1995 | Whaley |
| 5,577,852 | A | | 11/1996 | To |
| 5,755,513 | A | | 5/1998 | To |
| 5,842,807 | A | | 12/1998 | To |
| 5,879,097 | A | | 3/1999 | Cheng |
| D419,598 | S | * | 1/2000 | Whaley ..... D19/32 |
| 6,019,538 | A | * | 2/2000 | Whaley ..... 402/75 |
| 6,033,144 | A | | 3/2000 | Ng et al. |
| D422,307 | S | * | 4/2000 | Whaley ..... D19/32 |
| 6,168,339 | B1 | | 1/2001 | To |

(Continued)

FOREIGN PATENT DOCUMENTS

DE 196 02 813 A1 8/1996

(Continued)

*Primary Examiner*—Boyer Ashley
*Assistant Examiner*—Mark Henderson
(74) *Attorney, Agent, or Firm*—Senniger Powers

(57) ABSTRACT

Ring binder mechanism with special pronged fasteners secured thereto for fastening it to a binder, the special fastener per se, and a method of making the fasteners involving sheet metal stamping.

30 Claims, 10 Drawing Sheets

U.S. PATENT DOCUMENTS

| | | | | |
|---|---|---|---|---|
| D438,244 | S * | 2/2001 | Whaley | D19/32 |
| 6,394,686 | B1 * | 5/2002 | Whaley et al. | 402/26 |
| D461,498 | S * | 8/2002 | To et al. | D19/32 |
| D466,153 | S * | 11/2002 | To et al. | D19/32 |
| 2002/0131810 | A1 * | 9/2002 | Whaley et al. | 402/70 |

FOREIGN PATENT DOCUMENTS

| | | |
|---|---|---|
| GB | 954 417 | 4/1964 |
| GB | 1 111 435 | 4/1968 |
| GB | 1 484 908 | 9/1977 |

* cited by examiner 1
3
5
7
9
11
13
15
19
25
41
42

FASTENING BINDER RING MECHANISMS TO BINDERS

BACKGROUND OF THE INVENTION

This invention relates to the fastening of binder ring mechanisms to binders, encompassing ring mechanisms incorporating fasteners for the purpose, fasteners per se, and a method of making fasteners.

The invention involves improvement in the fastening of binder ring mechanisms to a binder and the fasteners per se over predecessors such as shown in the following U.S. patents:

| U.S. Pat. No. | Date | Title |
|---|---|---|
| 5,160,209 | Nov. 3, 1992 | Fastener Assembly for Concealably Fastening a Paper Retaining Mechanism to a Binder |
| *5,755,513 | May 26, 1998 | Ring Binder |
| *5,842,807 | Dec. 1, 1998 | Ring Binder |
| 6,019,538 | Feb. 1, 2000 | Clinch Fastener for a Ring Binder |
| *6,033,144 | Mar. 7, 2000 | Ring Binder Mechanism |
| *6,168,339 B1 | Jan. 2, 2001 | Ring Binder |

*Assigned to the assignee of this application.

BRIEF SUMMARY OF THE INVENTION

Among the several objects of the invention may be noted the provision of improvement in the fastening of binder ring mechanisms to binders (e.g. to cardboard loose-leaf binders); the provision of such fastening making for stronger, more secure attachment of the mechanism to the binders; the provision of fasteners for application to the mechanisms for the enhancement of the securement; and the provision of a superior method of making fasteners.

In general, a ring mechanism of the invention comprises an elongate plate carrying ring components and ring-operating components of the mechanism, said plate having pronged fasteners secured thereto for fastening it to a binder. Each fastener comprises a body generally of cup shape having an end formation constituting one end of the body and a peripheral wall flaring outward from said end formation to the other end of the body, where it is open. Said other end is larger than said one end and has prongs formed integrally therewith projecting from said open end thereof for effecting the fastening of the mechanism to a binder, said end formation being secured to said plate.

The fastener, per se, of the invention comprises a body generally of flaring cup shape with prongs at its open (and larger) end as set forth above.

The method of the invention for making the fasteners generally comprises the punching of fastener bodies generally of cup shape from a sheet of sheet metal, the cup-shaped bodies being integral with the sheet extending in one direction from one face of the sheet, each with an open end at the sheet. This is followed by striking prongs out of the sheet in a pattern around the open end of each of the cup-shaped bodies, the prongs being angled with respect to the sheet in the opposite direction. The pattern is such that each of the cup-shaped bodies remains attached to the sheet at at least one gap in the pattern. Each cup-shaped body is subsequently separated from the sheet at the respective gap.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
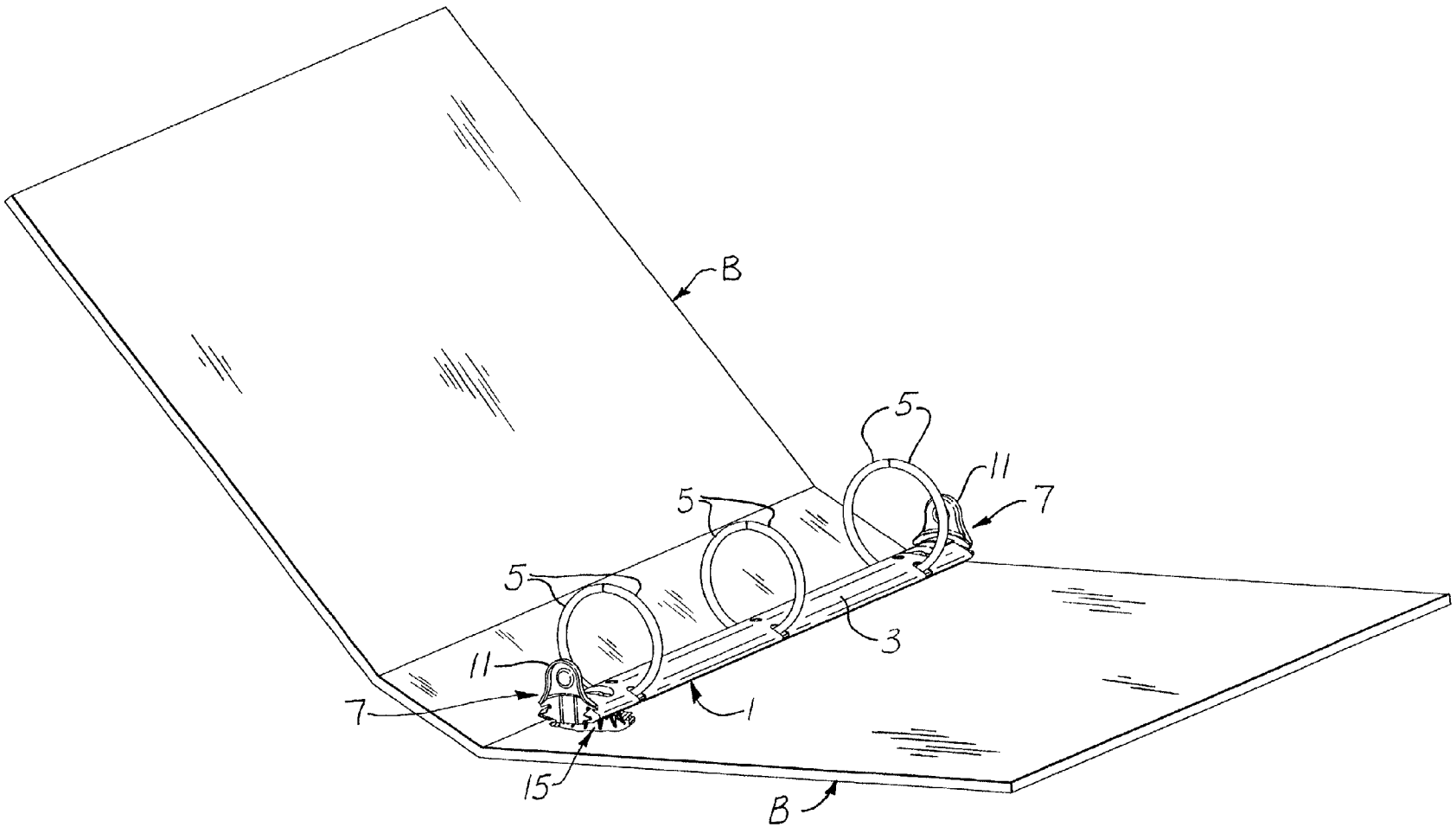
FIG. 1 is a perspective illustrating a three-ring binder mechanism such as may have fasteners of this invention thereon fastened to a binder.
Figure 2:
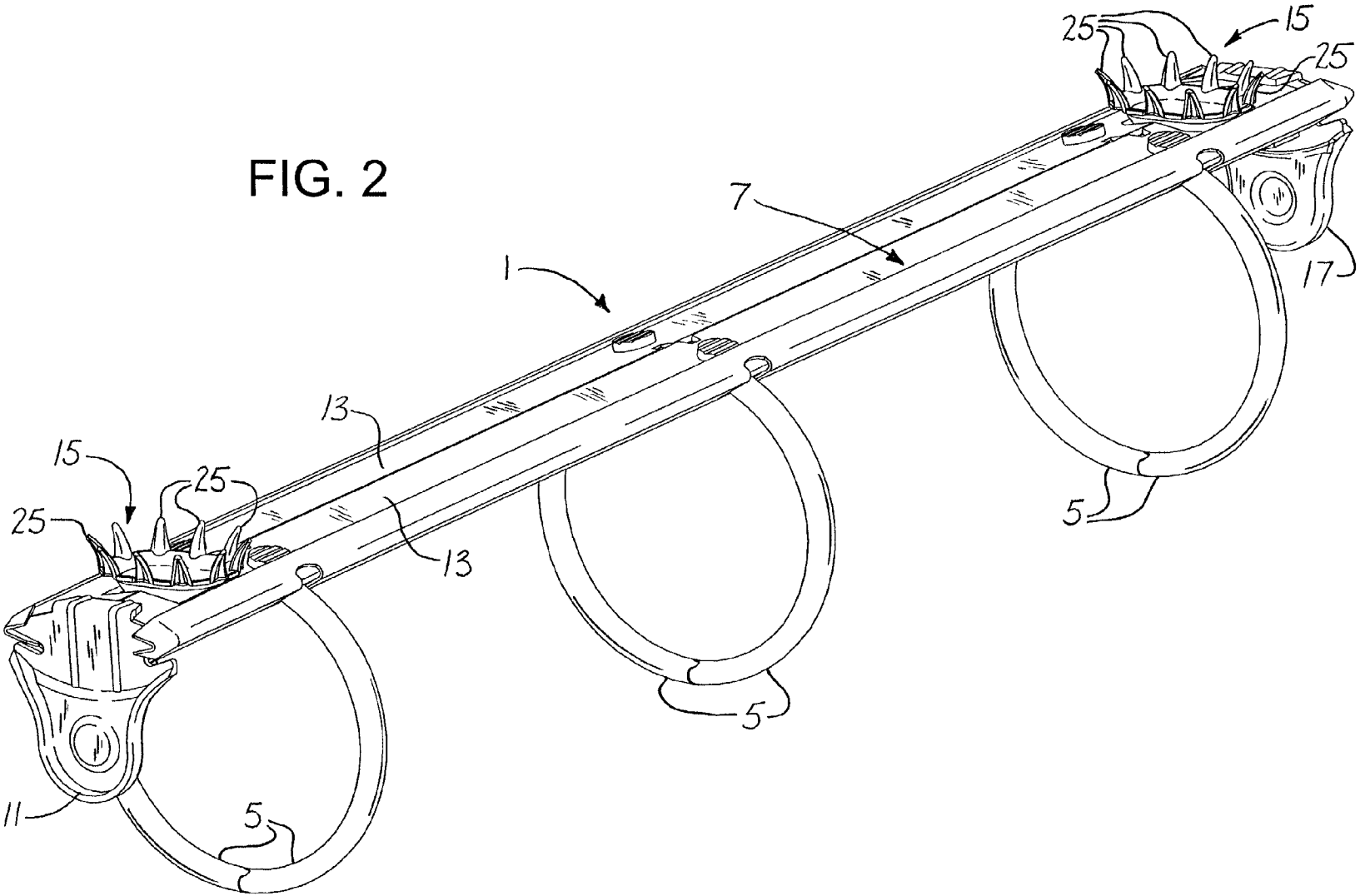
FIG. 2 is a perspective illustrating the ring binder mechanism viewed from the underside thereof.
Figures 3A, 3B, 3C:
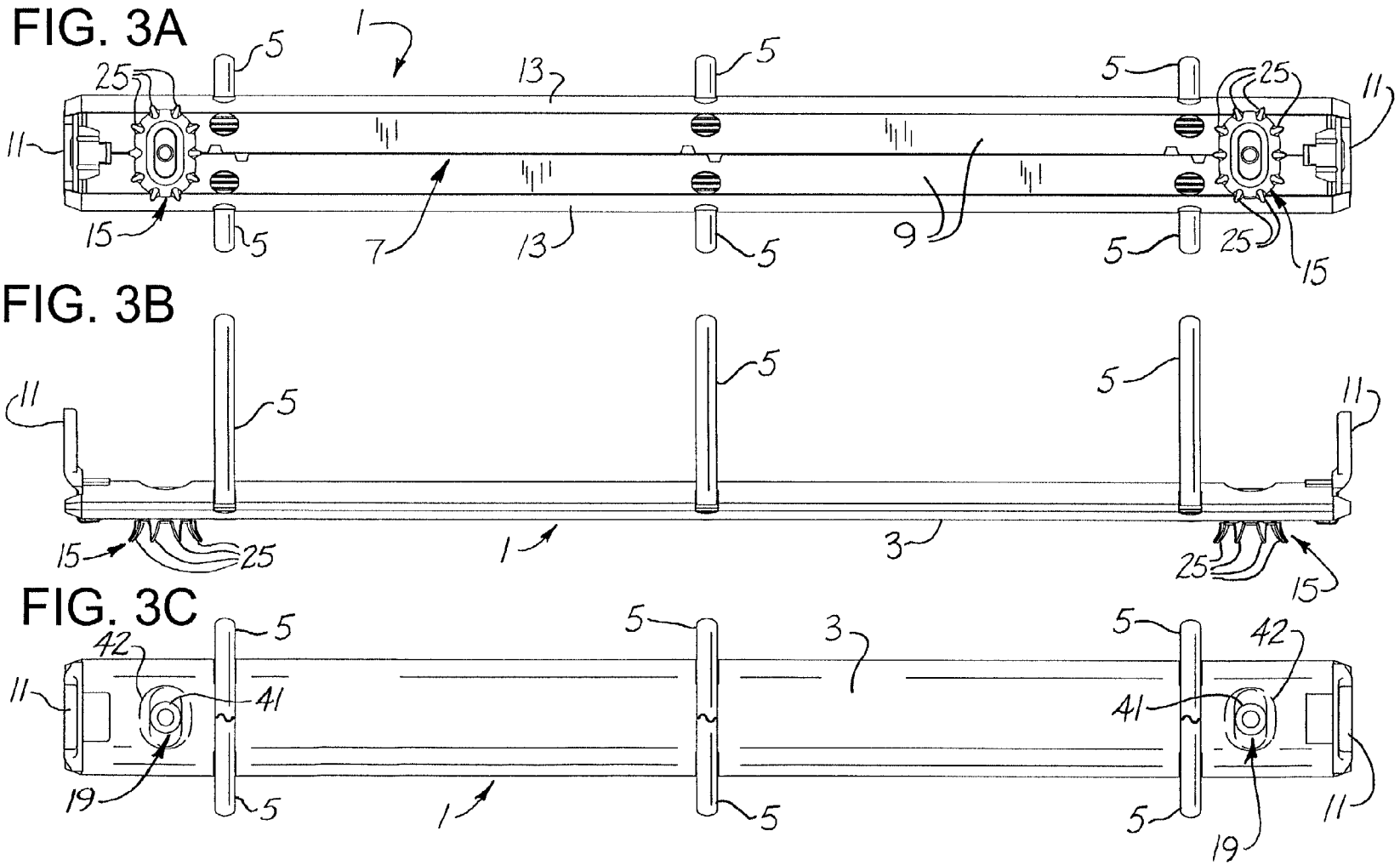
FIGS. 3A, 3B and 3C are a view in plan of the underside, a side elevation, and a view in plan of FIG. 3B, respectively.

Referring to FIGS. 1, 2, 3A–C, 8A, 8B and 9, a ring mechanism of this invention having fasteners of this invention for fastening the mechanism to a binder is designated in its entirety by the reference numeral 1, a typical binder, designated B, being shown in FIG. 1. The ring mechanism 1 comprises an elongate plate 3 carrying the ring components 5 and ring-operating components 7 of the ring mechanism. In detail, plate 3, generally a sheet metal plate, extends for the length of the mechanism, constituting what may be termed the "spine" thereof. The ring components 5 are half-rings secured at what are in effect inner ends thereof to ring-operating components constituted by elongate pivot plates each designated 9 pivotally carried by plate 3 underneath the latter. The pivot plates are swingable between a ring-closing position and a ring-opening position by ring-operating components constituted by levers 11 (sometimes called "boosters") pivoted at the ends of plate 3. Plate 3 is arched and has inturned flanges 13 on both sides extending its full length capturing the pivot plates. As thus far described, the mechanism is conventional and well known in the art.

Adjacent each end of the ring mechanism 1 is a pronged fastener of this invention for fastening the mechanism to the binder B. Each of the fasteners, designated 15 in its entirety, comprises a body 17 generally of cup shape having an end formation generally designated 19 constituting one end of the cup-shaped body and a peripheral wall (or skirt) generally designated 21 flaring outward (downward as shown in FIGS. 4, 6, 7 and 9) from said end formation to the other end of the body, where it is open as indicated at 23, the open end at 23 being larger than the end formation. The cup-shaped body 17 has prongs 25 formed integrally therewith projecting from the open end 23 for effecting the fastening of the ring mechanism 1 to a binder B as will be subsequently described. The end formation 19 is secured to plate 3 as will be subsequently described.

Figure 4:
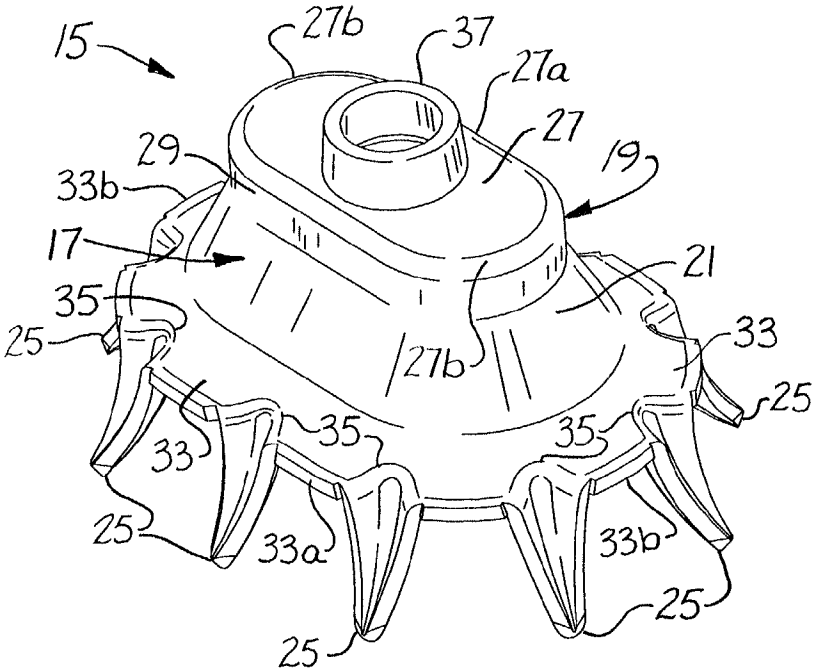
FIG. 4 is a perspective of a fastener per se of the invention.
Figure 6:
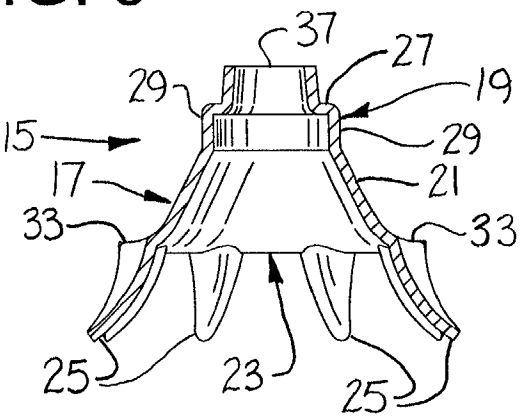
FIGS. 6 and 7 are sections on lines 6—6 and 7—7, respectively, of FIG. 5.
Figure 7:
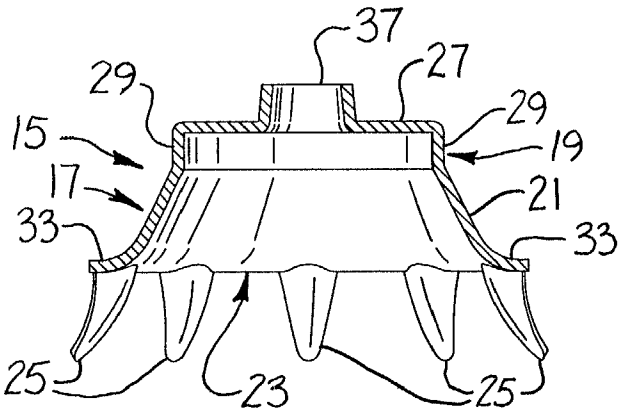
Figure 5:
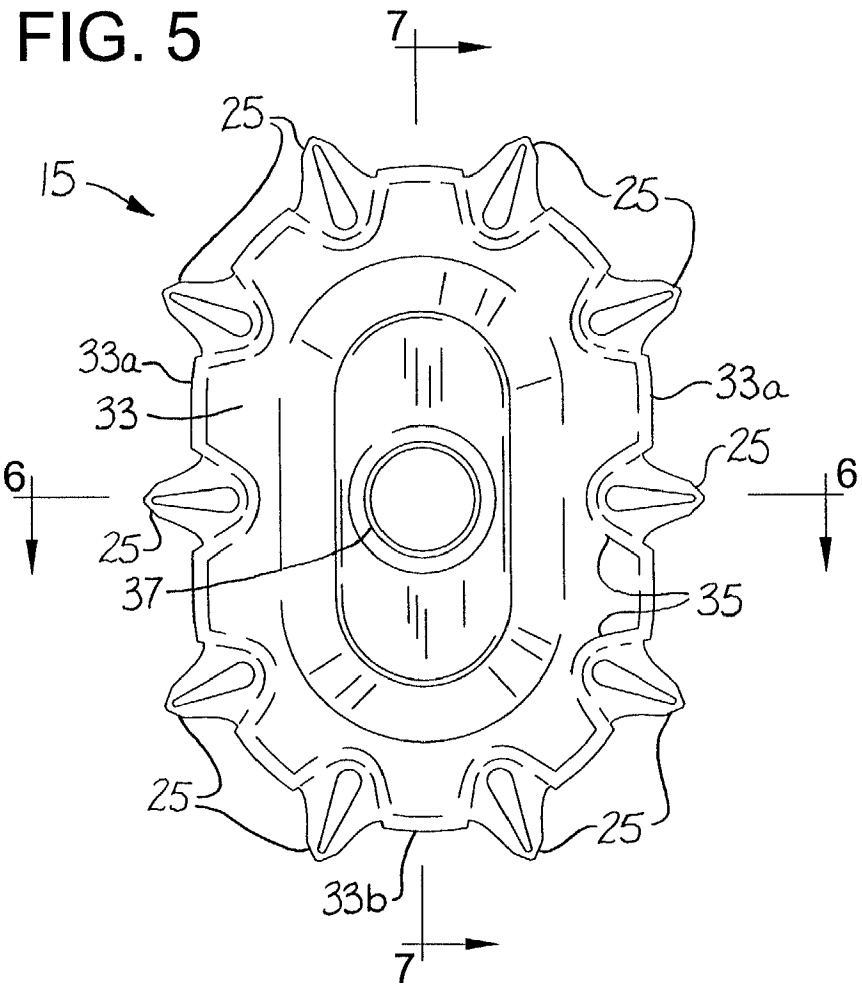
FIG. 5 is a plan of FIG. 4.

The end formation 19 constituting the said one end of the cup-shaped body 17 is elongate, as readily seen in FIGS. 4 and 5, and the peripheral wall 21, is tapered, being of gradually enlarging transverse cross-section from said one end 19 to said other (open) end 23 of the cup-shaped body. The fastener 15 comprises a one-piece sheet metal stamping, its said one end 19 (end formation 19) comprising a generally flat wall 27, constituting what may be referred to as the proximal end of the cup-shaped body 17, having a narrow surrounding flange 29 depending therefrom at right angles thereto. Wall 27 is generally elliptical, having straight sides 27*a* and curved (e.g. semi-circular) ends 27*b*. The peripheral wall 21 of the cup-shaped body 17 accordingly is of gradually enlarging generally elliptical (straight-sided, curved-ended) outline in transverse cross-section from end 19 to the open end 23.

The cup-shaped body 17 is formed with a relatively narrow flange 33 extending outwardly from the tapered peripheral wall 21 at the open end 23 of the body. The prongs 25 are rooted in this flange as indicated at 35, spaced at intervals around said open end 23, being of curved formation curving down and away therefrom as viewed in FIGS. 4, 6 and 7 (flaring away from the open end). As appears in FIG. 5, there are ten prongs, three on each side 33*a* and two on each curved end 33*b* of the peripheral flange 33 (which partakes of the generally elliptical shape of the open end 23 of the cup-shaped body 17).

Each of the two fasteners 15 of the ring mechanism 1 is secured on the inside of the plate 3 adjacent the respective end of the plate with its end wall 27 engaging the plate and secured thereto by a rivet 37 formed integrally with the end wall 27. The cup-shaped body 17 is initially formed with an integral cylindrical tubular stem constituting the rivet at the center of end wall 27, the stem extending through a rivet hole 39 in the plate 3 and its end swaged over on the plate as indicated at 41 (FIGS. 3C and 9) in a depression 42 in plate 3. Each fastener 15 is secured to the plate 3 at the respective end of the plate with the end wall 27, in its elongate (generally elliptic) form, extending transversely with respect to the plate. Thus, each of fasteners 15 is secured to the plate 3 closely adjacent the lever 11 at the respective end of the plate, as is advantageous, with its entire set of prongs 25 (including those on the side of the end wall 27 away from the lever) relatively closely adjacent the lever 11.

Figure 8A:
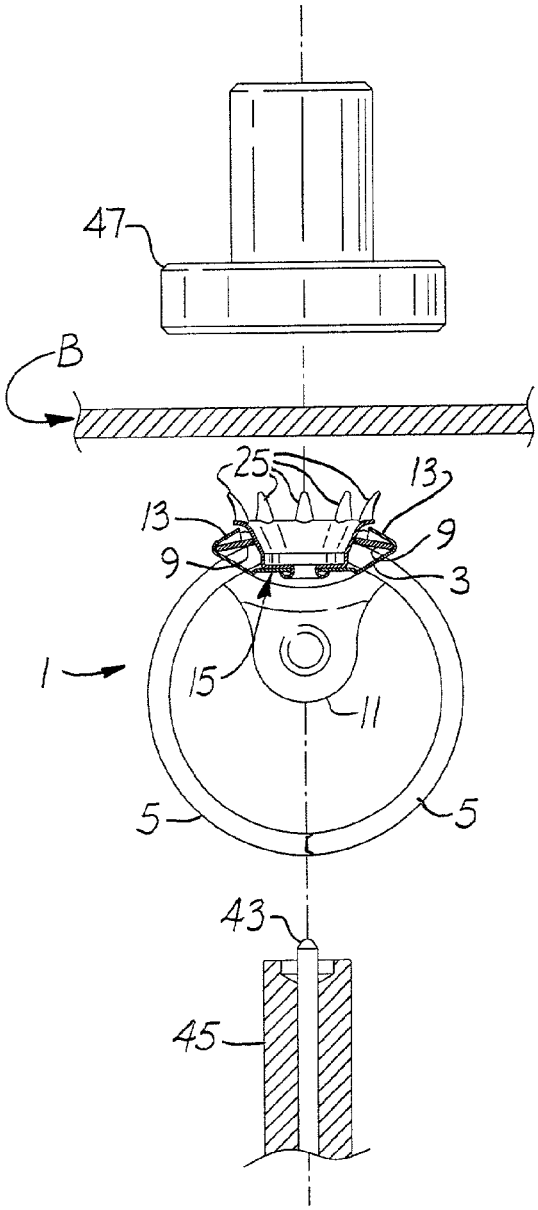
FIGS. 8A and 8B are views illustrating the assembly of the mechanism with a binder.
Figure 8B:
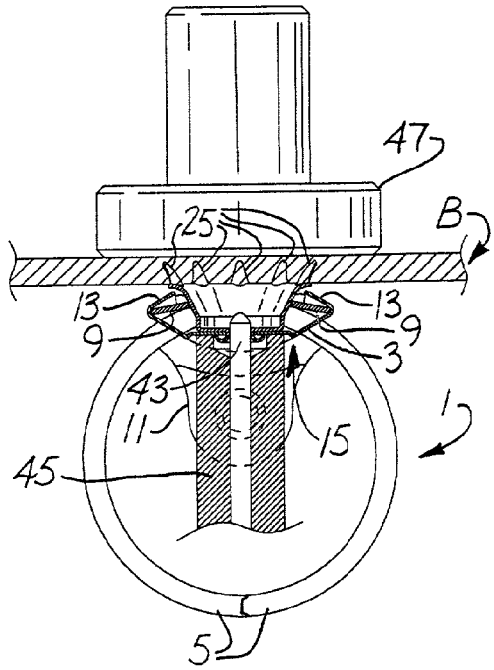
Figure 9:
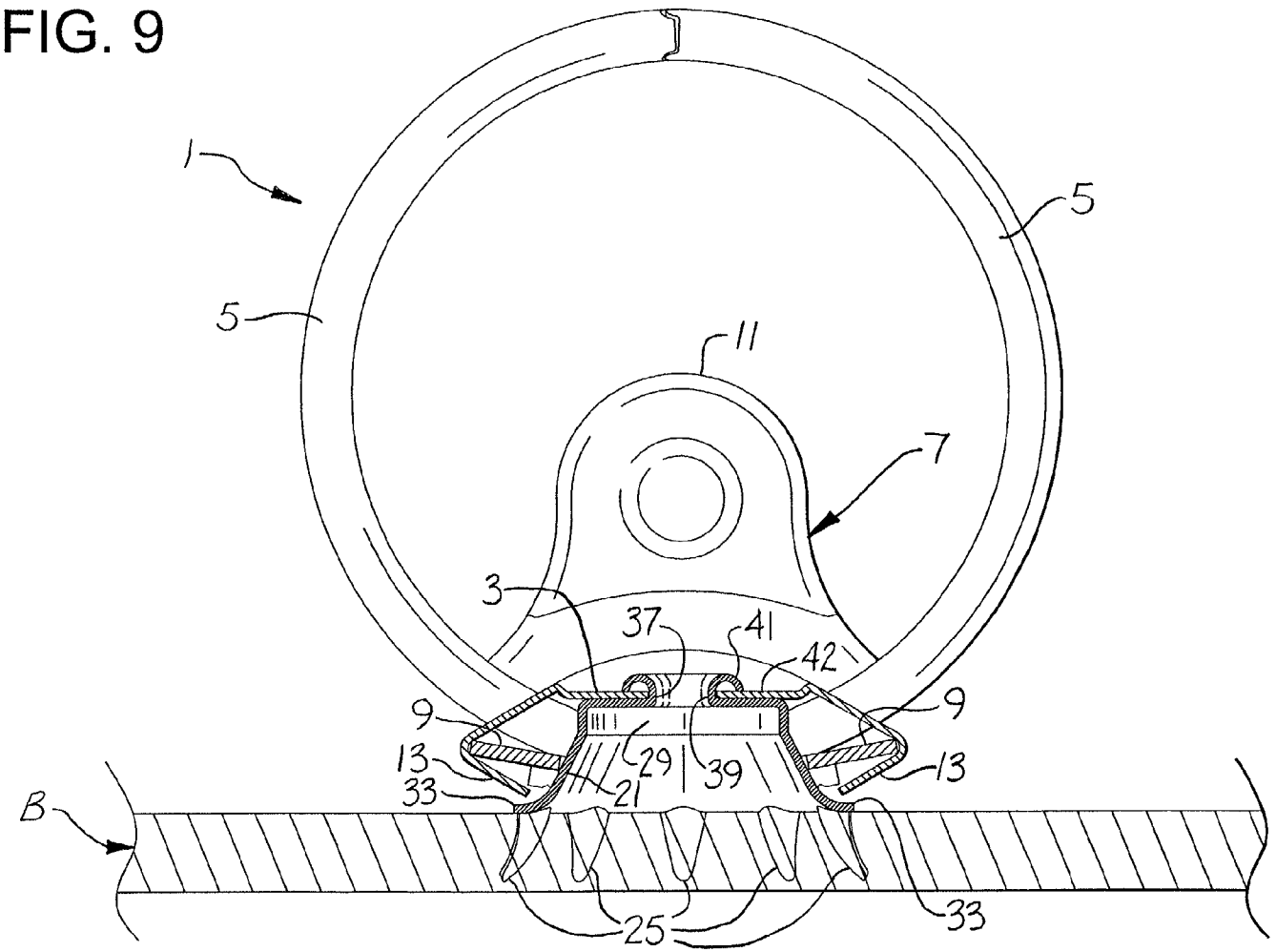
FIG. 9 is a view in section on a much larger scale than FIG. 8B showing the completed assembly.
Figure 12:
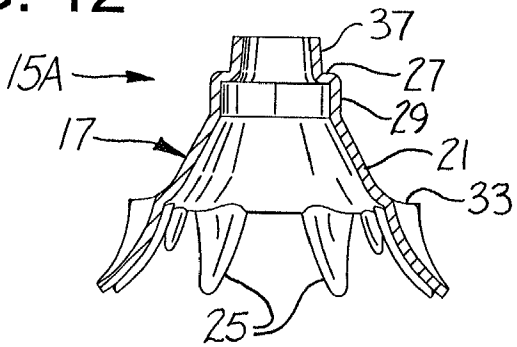
FIGS. 12 and 13 are sections on lines 12—12 and 13—13, respectively, of FIG. 11.
Figure 13:
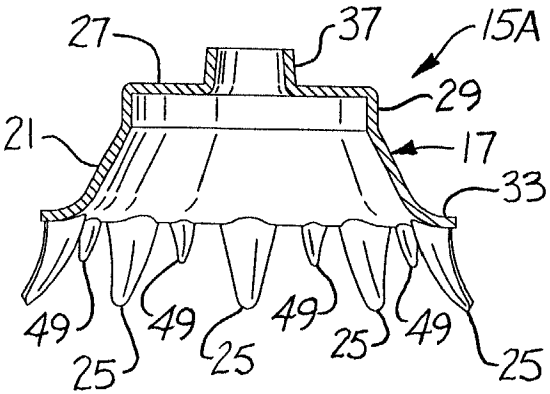
Figure 11:
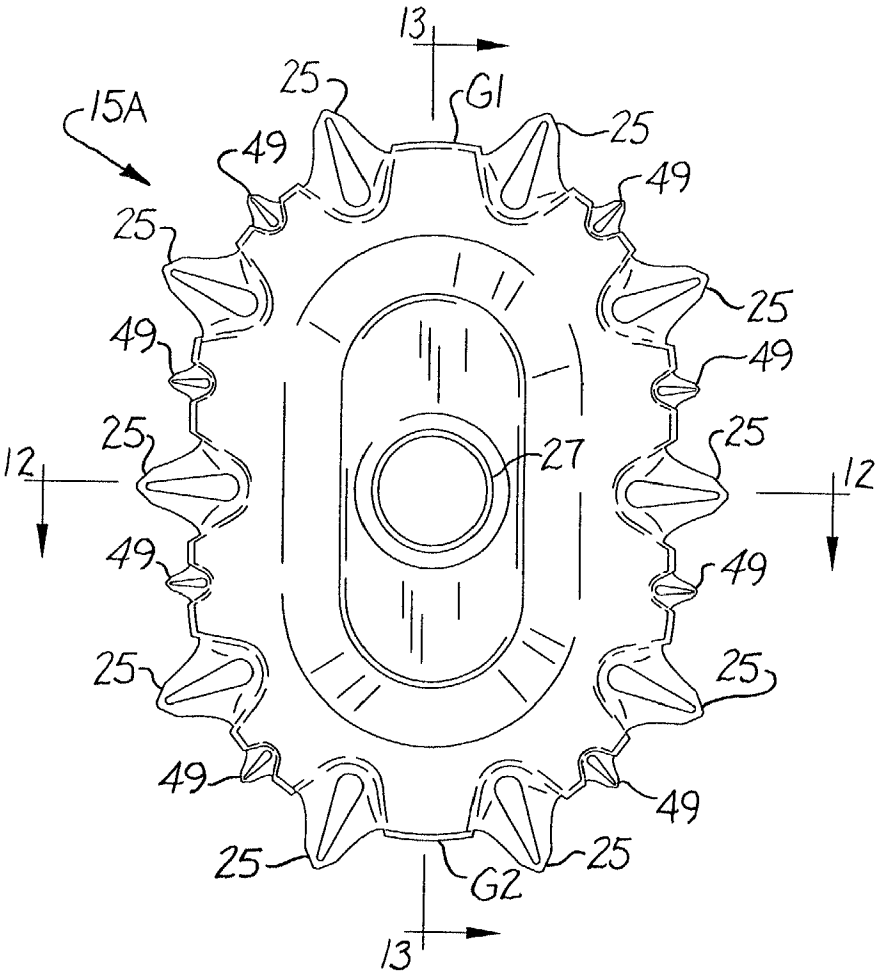
FIG. 11 is a plan of the FIG. 10 fastener.

The ring mechanism 1, with the fasteners 15 secured thereto, may be fastened to a binder B (e.g. one comprising cardboard) as shown in FIGS. 8A, 8B and 9. Referring first to FIG. 8A, the ring mechanism 1 is shown in prongs-up position below binder B for reception in a rivet hole 39 in plate 3 of the ring mechanism of a locating pin 43 extending up from an anvil 45; FIG. 8A also shows a pressure head 47 above the binder, and FIG. 8B shows the ring mechanism 1 impaled on pin 43, backed up by the anvil 45, and the presser head 47 down on the binder B, resulting in the penetration of the prongs 25 into the binder, thus effecting the fastening of the ring mechanism 1 to the binder as shown in enlarged manner in FIG. 9.

FIGS. 10–13 show a modification of the fastener for the most part like fastener 15 and denoted 15A in its entirety, differing primarily from fastener 15 in having relatively small teeth 49 formed integrally on flange 33 in the gaps between the five prongs on one side and the five prongs on the other side (thus having four teeth 49 on each side). Of significance is the absence of a tooth in the gap between the two prongs at each end of the flange (the reason therefor will become apparent later).

The flaring (tapering) configuration of the peripheral wall 21 (as sharply distinguished from a non-flaring or non-tapered, e.g., cylindric, configuration) is especially noteworthy in that it provides for effective transfer of force to theprongs so that they can be driven deep into the binder without requiring a relatively large rivet hole in the plate 3. Also noteworthy is the elongated (generally elliptical) shape of fasteners 15, enabling their affixation to the plate 3 with all prongs 25 in close proximity to the ends of the ring mechanism (desirable for keeping portions of the binder adjacent the ends of the mechanism affixed thereto). And also noteworthy is the provision of the flange 33 at the open end 23 of the cup-shaped body 17, said flange (in addition to being what is in effect a base for prongs 25) acting as a limit stop engageable with the binder B on the pressing of the prongs into the binder (FIG. 8B) to limit the penetration so as to prevent the prongs from going through the binder.

Figure 14:
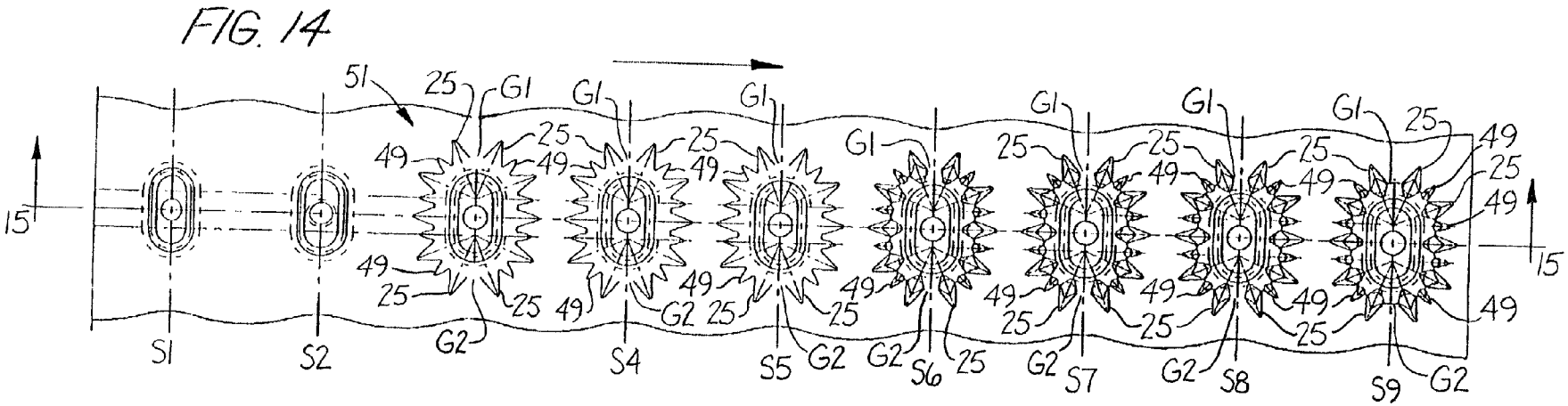
FIGS. 14 and 15 are views illustrating a method of the invention for making FIG. 10 fasteners, FIG. 15 being generally in section on line 15—15 of FIG. 14 and showing at the right thereof a transverse section of the fastener at the right end of these figures.
Figure 15:
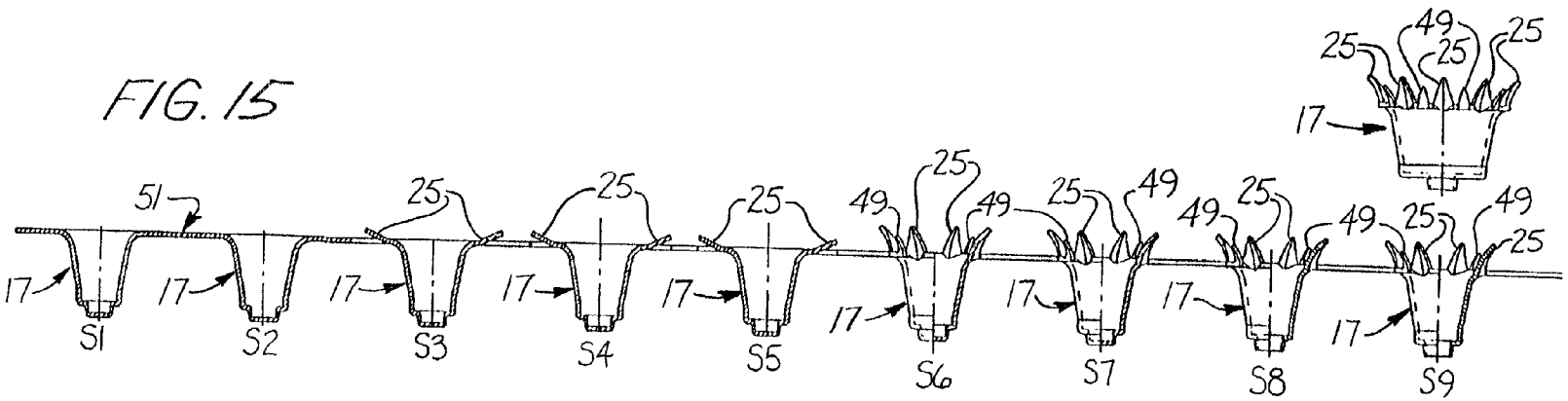

FIGS. 14 and 15 illustrate a method of this invention for making the fasteners 15A with the teeth 49, the principles of this method also being applicable to making of fasteners 15 and others, comprising punching (stamping out) cup-shaped bodies 17A from a sheet 51 of sheet metal (specifically, e.g. 0.028 inch thickness steel), the cup-shaped bodies 17A being integral with the sheet extending in one direction from one face of the sheet, each with its open end 23 at the sheet. As shown in FIGS. 14 and 15, each punched-out body 17A has the flaring (tapered) peripheral wall 21 and the elliptical wall 27 with the rivet hole 39. As shown in FIG. 15, the cup-shaped bodies 17 extend down from below the underside (bottom face) of the sheet 51 and the tapered peripheral wall 21 extends down from the sheet. Prongs 25 and teeth 49 are struck out of the sheet in the pattern of FIG. 10 around the open ends 23 of the bodies, the prongs and the teeth being angled in the opposite direction (up as appears in FIG. 15) with respect to the sheet 51. The pattern is such that the bodies, with the upstruck prongs 25 and teeth 49 are separated (detached) from the sheet at the prongs and teeth and also between the prongs and the teeth so as to form the flange 33 around the open end 23 of each body with the prongs and teeth rooted in the flange 33, but remain attached to the sheet 51 at at least one gap in the pattern. Preferably, at this stage, each body 17 remains attached to the sheet at two "toothless" gaps as indicated at G1 and G2, each "toothless" gap being between the two prongs at the respective end of the generally elliptical open end 23 of the body. At first, the striking up of the prongs and teeth is only partial as indicated at the positions indicated at S3, S4, S5 in FIG. 15, the striking up being completed at the position indicated at S6. Finally, each cup-shaped body 17 with the prongs and teeth rooted in flange 33 is separated from the sheet at the gaps G1 and G2.

The sheet 51 may be a strip of sheet metal (the term "sheet" being considered as encompassing a "strip"), fed forward intermittently in steps such as indicated at in FIGS. 14 and 15 in a feed path with a dwell at each of stations indicated at S1–S9. The punching of the strip to form the cup-shaped bodies 17 may be carried out by a suitable punch press at station S1, the preliminary up-striking of the prongs 25 and teeth 49 may be carried out by suitable tooling at station S3, the final up-striking by suitable tooling at station S6 and the final separation by suitable tooling at station S9 (as shown).

Figure 10:
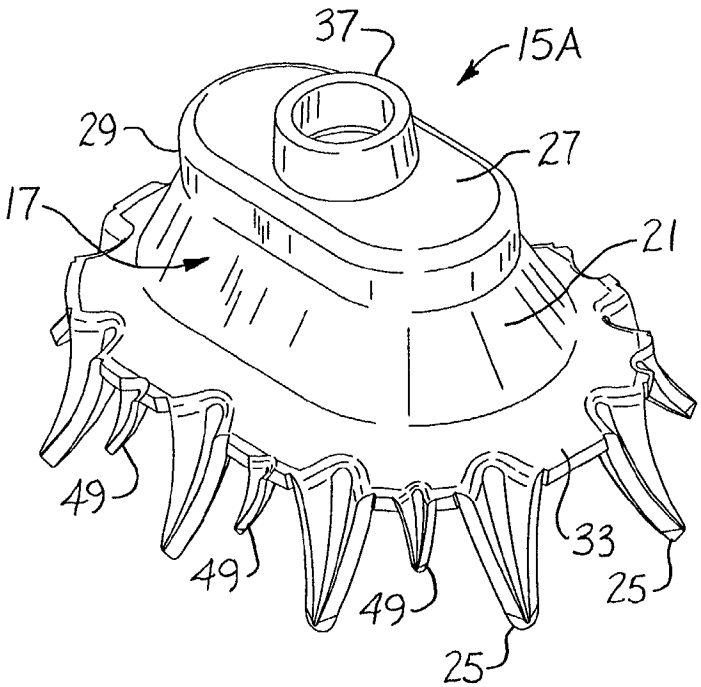
FIG. 10 (sheet 4) is a perspective of a modified version of the fastener.
Figure 17:
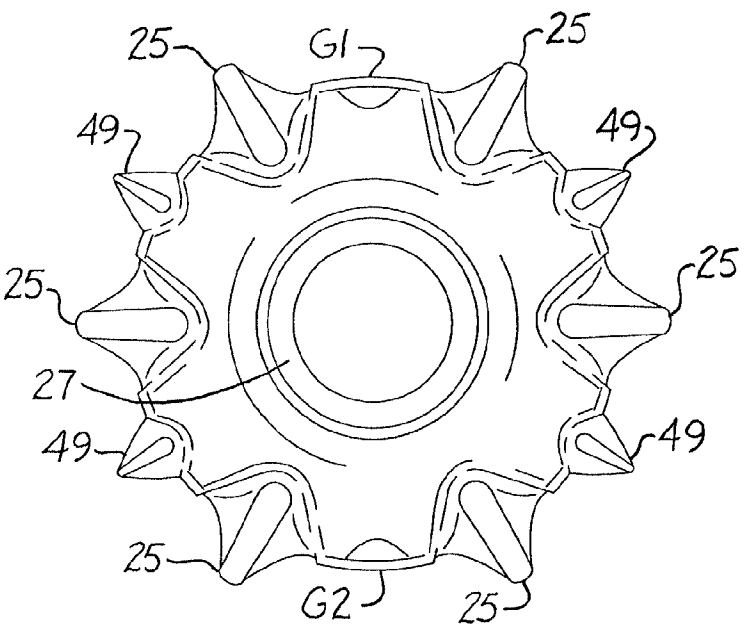
FIG. 17 is a plan of the FIG. 16 fastener.
Figure 16:
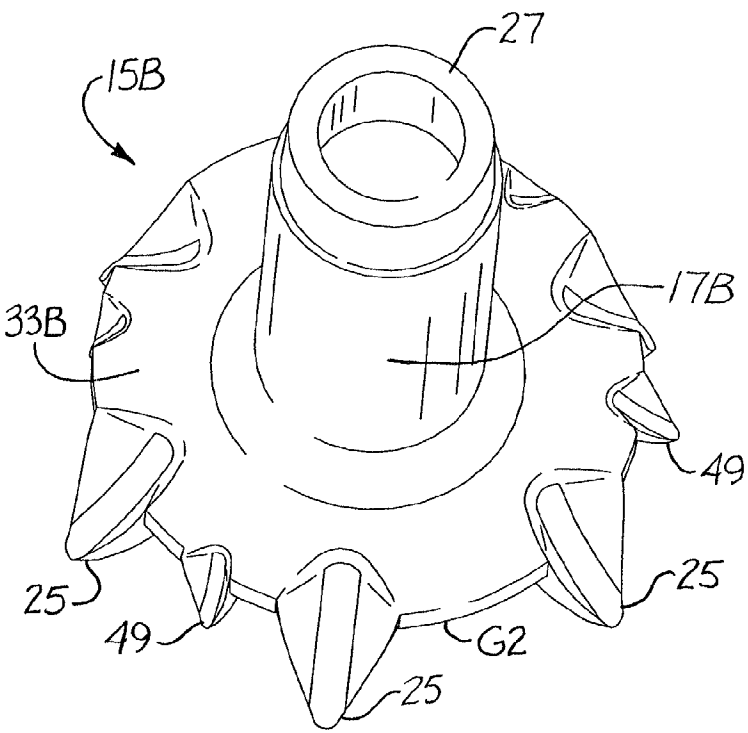
FIG. 16 is a perspective of another fastener that may be similarly made.

FIGS. 16 and 17 illustrate a fastener 15B having a flange 33B and prongs 25 and teeth 49 rooted in the flange similarly to FIG. 10, but with a cylindric cup-shaped body 17B instead of a tapered body, which may be made by the above-described method. Note the absence of teeth in gaps G1 and G2. While this may not partake of the advantage of the tapered peripheral wall as heretofore described of having a broader base for more prongs for enhanced fastening of the ring mechanism to the binder, it partakes of the teeth plus prongs characteristic, the gap principle, and the susceptibility of manufacture akin to that illustrated in FIGS. 14 and 15.

In view of the above, it will be seen that the several objects of the invention are achieved and other advantageous results attained.

As various changes could be made in the above constructions and method without departing from the scope of the invention, it is intended that all matter contained in the above description and shown in the accompanying drawings shall be interpreted as illustrative and not in a limiting sense.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A ring mechanism for a loose-leaf binder comprising an elongate plate carrying ring components and ring-operating components of tho mechanism, said plate having a longitudinal axis and pronged fasteners secured to the plate for fastening it to a binder, each fastener comprising an elongate, generally cup-shaped body having an end formation constituting one end of the body and a peripheral wall flaring outward from said end formation to an open end of the body, the elongation of the body being in a widthwise direction transverse to the longitudinal axis of the plate, said peripheral wall being of gradually enlarging outline in transverse cross-section from said one end to said open end such that said open end is larger than said one end, and having prongs formed integrally with said body projecting from said open end thereof for effecting the fastening of the mechanism to a binder, said end formation being secured to said plate, the ring mechanism having a fastener adjacent each end of the plate with the elongate end formation oriented transversely with respect to the plate.

2. A ring mechanism as set forth in claim 1 wherein said one end is generally elliptical and said peripheral wall is of gradually enlarging elliptical outline in transverse cross-section from said one end to said open end.

3. A ring mechanism as set forth in claim 1 wherein each fastener comprises a one-piece sheet metal stamping, said one end of the body comprising an end wall, the latter being secured to said plate.

4. A ring mechanism as set forth in claim 1 wherein said cup-shaped body has a flange extending outwardly from said peripheral wall at said open end of the cup-shaped body, said prongs being rooted in said flange at spaced intervals therearound and flaring away from said open end of the cup-shaped body.

5. A ring mechanism as set forth in claim 1 wherein the end formation further comprises a generally flat end wall and a surrounding flange extending from said flat end wall generally at right angles thereto.

6. A ring mechanism as set forth in claim 2 wherein said one end has straight sides and curved ends and said peripheral wall likewise has straight sides and curved ends.

7. A ring mechanism as set forth in claim 3 wherein the end wall at said one end of the body engages said plate and is secured thereto by having a rivet formed integrally therewith extending through a rivet hole in the plate and swaged over on the plate.

8. A ring mechanism for a loose-leaf binder comprising an elongate plate carrying ring components and ring-operating components of the mechanism, said plate having pronged fasteners secured thereto for fastening it to a binder, each fastener being a one-piece sheet metal stamping comprising a body generally of cup shape having a generally elliptical end wall constituting one end of the body and a peripheral wall flaring outwardly from said end wall to an open end of the body, said peripheral wall being of gradually enlarging elliptical outline in transverse cross-section from said one end of the body to said open end constituting the open end of the body) said open end being larger than said one end, said body having a flange extending outwardly from said peripheral wall at said open end, and a plurality of prongs integral with the body, said prongs being rooted in the flange at spaced intervals therearound and flaring away from said open end, said end wall engaging said plate and being secured thereto extending transversely of the plate by a rivet formed integrally with said end wall extending through a rivet hole in the plate and swaged down on the plate.

9. A fastener for application to a side of a ring mechanism for a binder for fastening the ring mechanism to a binder, said fastener comprising a body generally of cup shape having an end formation constituting one end of the body, said end formation comprising a flat end wall engageable with said ring mechanism on the same side of the ring mechanism where the body is located, and a peripheral wall flaring outward from said end formation to an open end of the body, said open end being larger than said one end and having a plurality of prongs formed integrally with said body and projecting from said open end thereof for effecting the fastening of the mechanism to a binder, said flat end wall being preformed to engage the ring mechanism prior to securing the fastener to the mechanism, said peripheral wall being of gradually enlarging elliptical outline in transverse cross-section from said one end to said open end.

10. A fastener as set forth in claim 9 wherein said one end has straight sides and curved ends and said peripheral wall likewise ban straight sides and curved ends.

11. A fastener for application to a side of a ring mechanism for a binder for fastening the ring mechanism to a binder, said fastener comprising a one-piece sheet metal stamping, the fastener including a body generally of cup shape having an end formation constituting one end of the body, said end formation comprising a flat end wall engageable with said ring mechanism on the same side of the ring mechanism where the body is located, and a peripheral wall flaring outward from said end formation to an open end of the body, said open end being larger than said one end and having a plurality of prongs formed integrally with said body and projecting from said open end thereof for effecting the fastening of the mechanism to a binder, said flat end wall being preformed to engage the ring mechanism prior to securing the fastener to the ring mechanism.

12. A fastener as set forth in claim 11 wherein said end wall has a rivet formed integrally therewith for securing it to a ring mechanism.

13. A fastener for application to a side of a ring mechanism for a binder for fastening the ring mechanism to a binder, said fastener comprising a body generally of cup shape having an end formation constituting one end of the body, said end formation comprising a flat end wall engageable with said ring mechanism on the same side of the ring mechanism where the body is located, and a peripheral wall flaring outward from said end formation to an open end of the body, said open end being larger than said one end and having a plurality of prongs formed integrally with said body and projecting from said open end thereof for effecting the fastening of the mechanism to a binder, said flat end wall being preformed to engage the ring mechanism prior to securing the fastener to the ring mechanism, said cup-shaped body having a flange extending outwardly from said peripheral wall at said open end of the cup-shaped body, said prongs being rooted in said flange at spaced intervals therearound and flaring away from said open end of the cup-shaped body.

14. A fastener for application to a ring mechanism for a binder for fastening the ring mechanism to a binder, said fastener being a one-piece sheet metal stamping comprising a body generally of cup shape having a generally elliptical end wall constituting one end of the body and a peripheral wall flaring outwardly from said end wall to an open end of the body, said peripheral wall being of gradually enlarging elliptical outline in transverse cross-section from said one end of the body to said open end constituting the open end of the body, said open end being larger than said one end, said body having a flange extending outwardly from said peripheral wall at said open end, and a plurality of prongs integral witch the body, said prongs being rooted in the flange at spaced intervals therearound and flaring away from said open end.

15. A fastener as set forth in claim 14 wherein said end wall has a rivet formed integrally therewith for securing it to a ring mechanism.

16. A fastener as set forth in claim 16 having teeth rooted in the flange interspersed between prongs.

17. A fastener for application to a ring mechanism for a binder for fastening the ring mechanism to a binder, said fastener comprising a sheet metal body generally of cup shape having an end formation constituting one end of thereof and a peripheral wall extending from said end formation to an open end of the body, said peripheral wall having a flange extending outwardly therefrom at its said open end, and a plurality of prongs formed integrally with said flange, said prongs being rooted in said flange at spaced intervals there around and defining gaps between the prongs, the prongs flaring away from said open end, and teeth rooted in the flange interspersed between prongs.

18. A fastener as set forth in claim 17 wherein there is at least one toothless gap between two adjacent prongs.

19. A ring mechanism for a loose-leaf binder comprising an elongate plate carrying ring components and ring-operating components of the mechanism, said plate having pronged fasteners secured thereto for fastening it to a binder, each fastener comprising a body generally of cup shape having an end formation constituting one end of the body and a peripheral wall flaring outward from said end formation to an open end of the body, said open end being larger than said one end and having a plurality of prongs formed integrally with said body for effecting the fastening of the mechanism to a binder, said end formation being secured to said plate, said cup-shaped body having a flange extending outwardly from said peripheral wall at said open end of the cup-shaped body, said prongs being rooted in said flange at intervals therearound and flaring away from said open end of the cup-shaped body.

20. A fastener for application to a ring mechanism for a binder for fastening the ring mechanism to a binder, said fastener comprising a body generally of cup shape having an end formation constituting one end of the body and a peripheral wall flaring outward from said end formation to an open end of the body, said open end being larger than said one end, said cup-shaped body having a flange extending outwardly from said peripheral wall at said open end, a plurality prongs for effecting the fastening of the mechanism to a binder, said prongs being rooted in said flange at intervals therearound and flaring away from said open end of the cup-shaped body.

21. A fastener for application to a ring mechanism for a binder for fastening the ring mechanism to a binder, said fastener comprising a body generally of cup shape having an end formation constituting one end of the body and a peripheral wall extending from said end formation to an open end of the body, said open end being larger than said one end, said cup-shaped body having a flange extending outwardly from said peripheral wall at said open end, a plurality prongs for effecting the fastening of the mechanism to a binder, said prongs being rooted in said flange at intervals therearound and flaring away from said open end of the cup-shaped body.

22. A fastener for application to a ring mechanism for a binder for fastening the ring mechanism to a binder, said fastener comprising a generally cup-shaped body having an end formation constituting one end of the body and a peripheral wall extending from said end formation to an open end of the body, said peripheral wall being of gradually enlarging outline in transverse cross-section from said one end to said open end such that said open end is larger than said one end, a plurality of prongs for effecting the fastening of the mechanism to a binder, said prongs being located at the open end of the body at intervals therearound and flaring laterally outwardly from the peripheral wall.

23. A fastener as set forth in claim 22 in combination with the ring mechanism.

24. A fastener for application to a side of a ring mechanism for a binder for fastening the ring mechanism to a binder, said fastener comprising a body generally of cup shape having an end formation constituting one end of the body, said end formation comprising a flat end wall engageable with said ring mechanism on the same side of the ring mechanism where the body is located, and a peripheral wall flaring outward from said end formation to an open end of the body, said open end being larger than said one end and having a plurality of prongs formed integrally with said body and projecting from said open end thereof for effecting the fastening of the mechanism to a binder, said end formation further comprising a surrounding flange extending from said flat end wall generally at right angles thereto.

25. A fastener for application to a side of a ring mechanism for a binder for fastening the ring mechanism to a binder, said fastener comprising a body generally of cup shape having an end formation constituting one end of the body, said end formation comprising a flat end wall engageable with said ring mechanism on the same side of the ring mechanism where the body is located, and a peripheral wall flaring outward from said end formation to an open end of the body, said open end being larger than said one end and having a plurality of prongs formed integrally with said body and projecting from said open end thereof for effecting the fastening of the mechanism to a binder, said flat end wall being preformed to engage the ring mechanism prior to securing the fastener to the ring mechanism, a projection of the flat end wall in the direction of the opened of the body being contained within the body.

26. A fastener as set forth in claim 25 wherein the flat end wall has a larger dimension in a first direction than in a second direction perpendicular to the first direction.

27. A fastener as set forth in claim 25 wherein a surface area of the flat end wall engaging the ring mechanism is greater than a surface area of the end formation engaging the ring mechanism on the opposite side of the ring mechanism.

28. A ring mechanism for a loose-leaf binder comprising an elongate plate carrying ring components and ring-operating components of the mechanism, said plate having pronged fasteners secured thereto for fastening it to a binder, each fastener comprising a body generally of cup shape located on one side of the elongate plate and having an end formation constituting one end of the body, said end formation comprising a substantially flat end wall engageable with said plate on the same side of the plate as the body for supporting said plate when attached to the binder, a peripheral wall flaring outward from said end formation to an open end of the body, said oven end being larger than said one end and having prongs formed integrally with said body projecting from said open end thereof for effecting the fastening of the mechanism to a binder, said end formation being secured to said plate, said flat end wall being preformed to engage the ring mechanism prior to secured the fastener to the ring mechanism, a projection of the flat end wail in the direction of the open end of the body being contained within the body.

29. A ring mechanism as set forth in claim 28 wherein the flat end wall has a smaller dimension in a direction along a longitudinal axis of the elongate plate than a dimension in a direction perpendicular to the longitudinal axis of the elongate plate.

30. A ring mechanism as set forth in claim 28 wherein a surface area of the flat end wall engaging the ring mechanism is greater than a surface area of the end formation engaging the ring mechanism on the opposite side of the ring mechanism.

* * * * *